US008991562B2

(12) United States Patent
Odermatt et al.

(10) Patent No.: US 8,991,562 B2
(45) Date of Patent: Mar. 31, 2015

(54) ELECTRICAL CONTACTING DEVICE FOR ELEVATOR SUPPORT TENSILE CARRIERS

(75) Inventors: Arnold Odermatt, Stans (CH); Christoph Bissig, Isenthal (CH); Hans Kocher, Udilgenswil (CH)

(73) Assignee: Inventio AG, Hergiswil (CH)

( * ) Notice: Subject to any disclaimer, the term of this patent is extended or adjusted under 35 U.S.C. 154(b) by 646 days.

(21) Appl. No.: 13/376,988

(22) PCT Filed: Jun. 30, 2010

(86) PCT No.: PCT/EP2010/059314

§ 371 (c)(1),
(2), (4) Date: Dec. 8, 2011

(87) PCT Pub. No.: WO2011/003791

PCT Pub. Date: Jan. 13, 2011

(65) Prior Publication Data

US 2012/0090924 A1 Apr. 19, 2012

(30) Foreign Application Priority Data

Jul. 6, 2009 (EP) ..... 09164695

(51) Int. Cl.

| | |
|---|---|
| ***B66B 1/34*** | (2006.01) |
| ***B66B 7/06*** | (2006.01) |
| ***B66B 7/12*** | (2006.01) |
| ***H01R 12/59*** | (2011.01) |

(52) U.S. Cl.

CPC ..... *B66B 7/062* (2013.01); *B66B 7/1223* (2013.01); *H01R 12/592* (2013.01)

USPC ..... 187/393; 187/411; 187/413; 439/405

(58) Field of Classification Search

USPC ..... 187/247, 248, 251, 261, 264, 277, 187/391–393, 411–414; 73/282, 831, 832, 73/839, 862.56; 57/210, 211, 212, 221, 57/232, 237, 241; 439/391, 395, 397, 402, 439/404, 405

See application file for complete search history.

(56) References Cited

U.S. PATENT DOCUMENTS

| | | | | |
|---|---|---|---|---|
| 4,145,920 | A * | 3/1979 | Yamagami | 73/158 |
| 5,426,362 | A * | 6/1995 | Ninnis | 324/235 |
| 6,073,728 | A * | 6/2000 | Olsen et al. | 187/414 |
| 6,633,159 | B1 * | 10/2003 | Robar et al. | 324/240 |

(Continued)

FOREIGN PATENT DOCUMENTS

| | | |
|---|---|---|
| DE | 2330038 A1 | 5/1974 |
| DE | 3934654 A1 | 5/1991 |

(Continued)

*Primary Examiner* — Anthony Salata

(74) *Attorney, Agent, or Firm* — Fraser Clemens Martin & Miller LLC; William J. Clemens

(57) ABSTRACT

A contacting device for electrically contacting tensile carriers of a suspension in an elevator system includes a housing having a recess in which an exposed segment of the suspension can be received so that the housing at least partially encloses the exposed segment of the suspension. Raised areas and recesses are alternatingly disposed on an inner side of the housing, wherein a raised area and a recess face each other in a state of use. At least one contact element is disposed in a recess of the housing, wherein the at least one raised area can be pressed against a tensile carrier of the suspension, such that the tensile carrier is brought into electrical contact with the contact element.

15 Claims, 5 Drawing Sheets

(56) References Cited

U.S. PATENT DOCUMENTS

| | | | | |
|---|---|---|---|---|
| 7,409,870 | B2 * | 8/2008 | Stucky et al. | 73/810 |
| 7,410,033 | B2 * | 8/2008 | Veronesi et al. | 187/391 |
| 7,506,728 | B2 * | 3/2009 | Hawkes et al. | 187/411 |
| 7,540,359 | B2 * | 6/2009 | Veronesi et al. | 187/413 |
| 7,819,690 | B2 * | 10/2010 | Faulkner et al. | 439/397 |
| 8,424,653 | B2 * | 4/2013 | Stucky et al. | 187/393 |
| 8,640,828 | B2 * | 2/2014 | Annen et al. | 187/251 |
| 2011/0192683 | A1 * | 8/2011 | Weinberger et al. | 187/254 |
| 2013/0153340 | A1 * | 6/2013 | Dold | 187/393 |
| 2013/0157497 | A1 * | 6/2013 | Dold et al. | 439/413 |
| 2014/0182974 | A1 * | 7/2014 | Puranen et al. | 187/247 |

FOREIGN PATENT DOCUMENTS

| | | | |
|---|---|---|---|
| WO | 2005094249 | A2 | 10/2005 |
| WO | 2005095251 | A1 | 10/2005 |
| WO | 2005095253 | A1 | 10/2005 |
| WO | 2006127059 | A2 | 11/2006 |

* cited by examiner

ELECTRICAL CONTACTING DEVICE FOR ELEVATOR SUPPORT TENSILE CARRIERS

CROSS-REFERENCE TO RELATED APPLICATIONS

Not Applicable

STATEMENT REGARDING FEDERALLY SPONSERED RESEARCH OR DEVELOPMENT

Not Applicable

THE NAMES OF THE PARTIES TO A JOINT RESEARCH AGREEMENT

Not Applicable

INCORPORATION-BY-REFERNCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION (1) Field of the Invention

The subject of the invention is a contacting device for monitoring a support means in an elevator installation.

(2) Description of Related Art Including Information Disclosed under 37 CFR 1.97 and 1.98

In many items of transport equipment, for example elevator installations, escalators, moving walkways, hoists or cranes, use is made of belt-shaped support means. These support means generally comprise several tensile carriers which consist of steel wires and which accept the tension forces to be absorbed by the support means. The tensile carriers are usually surrounded by a casing of plastics material. The casing protects the tensile carriers at least partly from mechanical effects. In addition, the casing improves the traction of the support means on deflecting or drive rollers and fixes the arrangement of tensile carriers relative to one another.

The support means are a safety-critical component within transport equipment. The failure or breakage thereof can in the extreme case lead to, for example, dropping down of a car together with the passengers therein. This can lead to considerable harm to objects and persons. For this reason, use is made in transport equipment of check units which, in particular, check the mechanical state of the tensile carriers. Damage to the tensile carriers accepting the forces shall thereby be able to be recognized in good time so that the support means can, in the case of damage, be exchanged in order to prevent failure of the transport equipment.

The tensile carriers are surrounded by an electrically insulating casing of plastics material. In order to carry out a check of the state of the tensile carriers, contacting of a contact element with the tensile carriers is required in some procedures. In a known procedure a current serving as a test current determining the state of the tensile carriers is conducted through the tensile carriers with the help of the contact element. Apart from that, other test methods which do not operate with electrical current, for example ultrasound, also come into consideration.

DE 39 34 654 A1 shows a support means forming the category. The ends of the tensile carriers are in that case conductively connected in pairs with a bridge part so that the tensile carriers of the support means are electrically connected in series. The tensile carriers of the support means are connected with a voltage source by way of an ammeter so that the state of the tensile carriers can be assessed by means of the test current which is conducted through all tensile carriers due to the electrical connection in series.

DE 2 330 038 shows a system for contacting a flat cable. In the illustrated flat cable several strands are arranged adjacent to one another within a plane and are surrounded by a casing. For electrical contacting of the strands the flat cable is clamped in place by an upper and a lower clamping member. Arranged at the lower clamping member are recesses through which prongs formed at a contact carrier can be guided. The prongs thereby penetrate the casing of the flat cable and thus come into contact with the strands. Contacting of the strands by means of the prongs thus takes place perpendicularly to a longitudinal axis of the strands. It is disadvantageously required with this contacting that the prongs penetrate the casing of the support means. Penetration of the casing by the prongs can, however, have the consequence that the prongs during penetration of the casing depart from the intended direction of insertion and as a result contact with the strand cannot be produced. The prongs can thus possibly also contact other, undesired strands or even contact no strands at all during penetration of the casing.

WO 2005/094249 A2 and WO 2006/127059 A2 show a system for contacting a support means in which the contact elements initially puncture the casing of the support means perpendicularly to a longitudinal axis of the tensile carriers and then penetrate into the tensile carriers. Disadvantageously, in that case the contact elements due to the required puncturing process through the casing can miss the tensile carriers.

BRIEF SUMMARY OF THE INVENTION

An object of the present invention accordingly consists of providing a contacting device for contacting a support means in which the tensile carriers of the support belt can be contacted reliably and in precise manner by a contact element so as to be able to ascertain a state of the tensile carriers. The contacting device shall be simple and reliable in handling as well as have low production costs and require use of few tools.

A contacting device for electrically contacting of tensile carriers of a support means in an elevator installation is proposed for fulfillment of this object. The contacting device comprises a housing with a recess in which a section of the support means is receivable so that the housing substantially encloses this section of the support means. The contacting device comprises at least one contact element which is preferably arranged in a depression of the housing. The contacting device has elevations and depressions which in an exemplifying embodiment are arranged in alternation adjacent to one another on inner sides of the housing and which project into one another in a use state. Through the projection of the elevations and depressions into one another the tensile carriers of the support means are held in the housing and the tensile carriers are brought into electrical contact with the contact elements.

In addition, an elevator installation with a car and a counterweight is proposed, wherein the car and the counterweight are movable by way of support means drivable by a drive and wherein a contacting device as described above is arranged at the support means.

Moreover, a method for electrical contacting of tensile carriers in a support means of an elevator installation is proposed. The method comprises an arrangement of a housing at an exposed section of the support means so that this section is substantially enclosed by the housing. The method comprises urging at least one tensile carrier out of its original position by means of at least one elevation arranged on an inner side of the housing so that electrical contact between at least one tensile carrier and a contact element arranged in the housing is produced.

BRIEF DESCRIPTION OF THE SEVERAL VIEWS OF THE DRAWING(S)

Details and advantages of the invention are described in the following by way of exemplifying embodiments and with reference to the schematic drawings, in which.

Figure 5A:
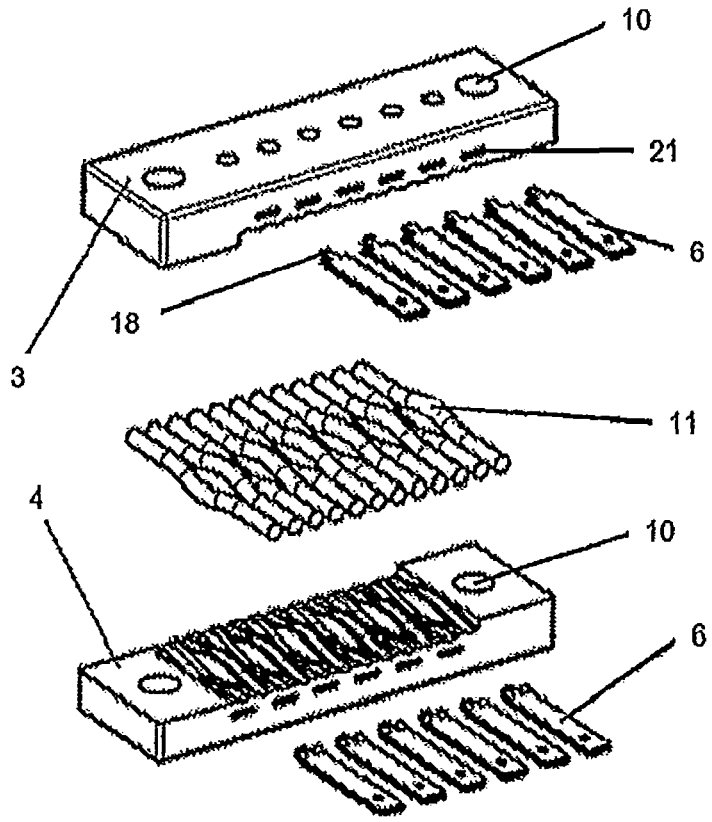
Figure 5B:
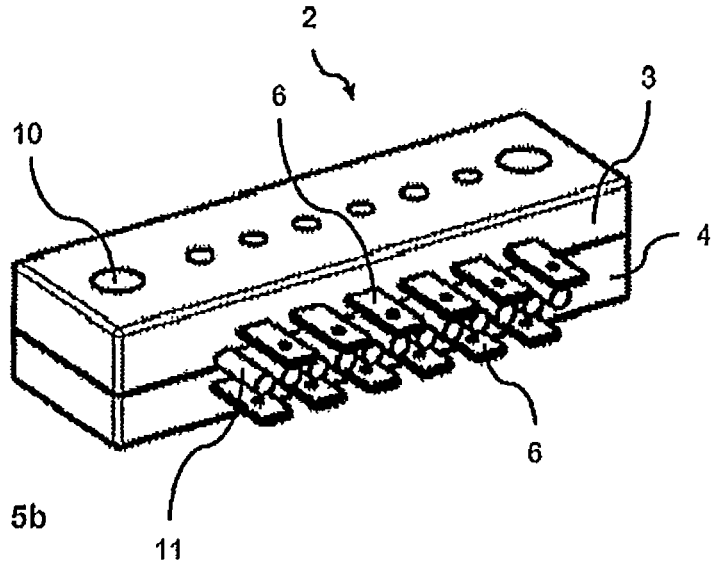
Figure 6A:
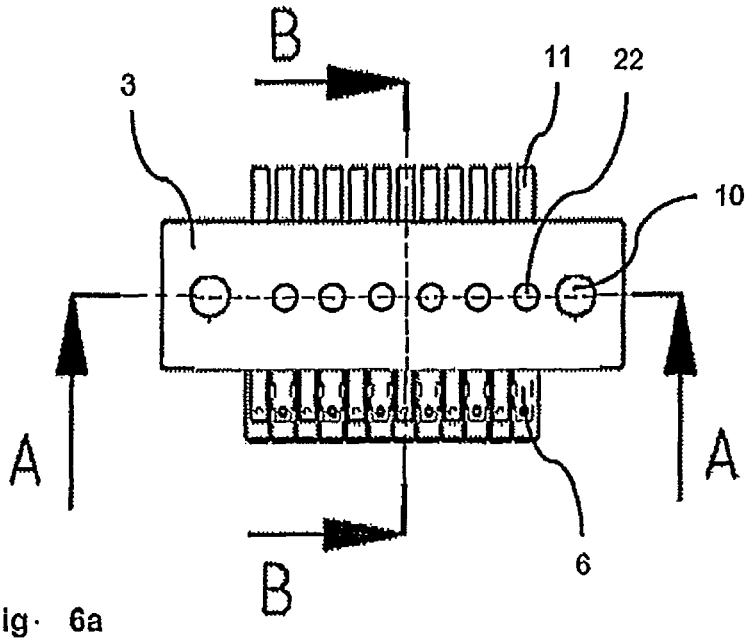
Figure 6B:
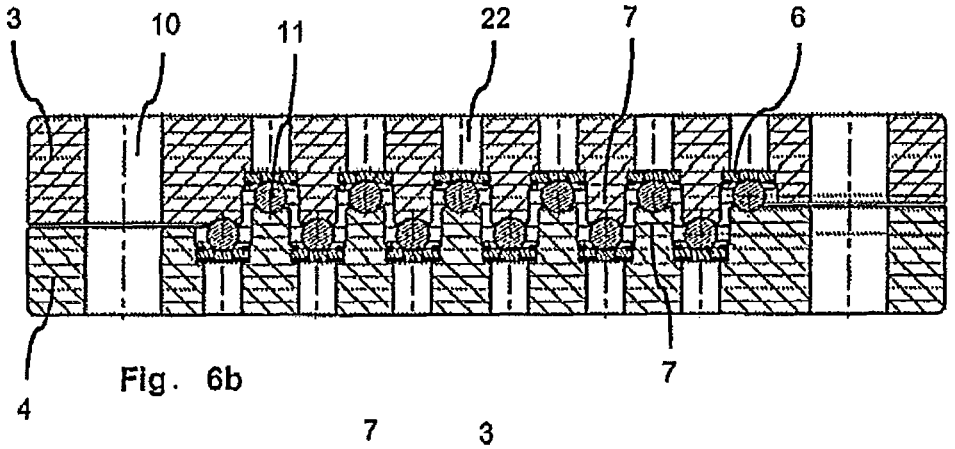
Figure 6C:
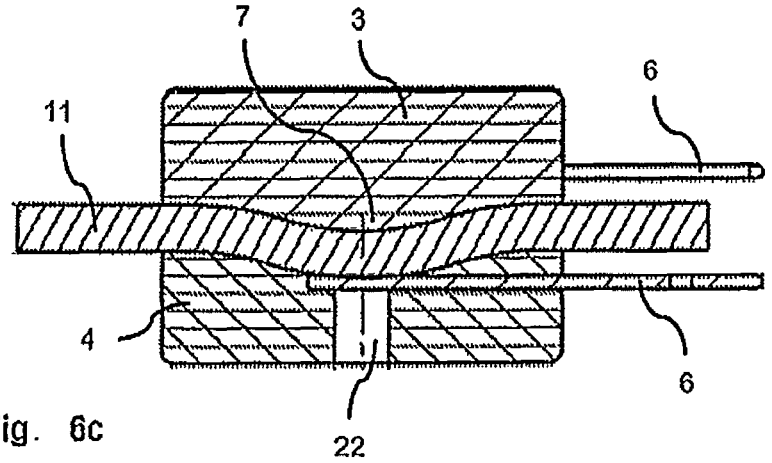
Figure 7:
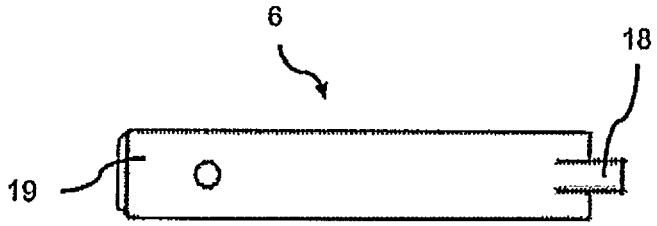

FIG. 5*a* shows an exploded illustration of an exemplifying form of embodiment of a contacting device and tensile carriers;

FIG. 5*b* shows an exemplifying form of embodiment of a contacting device and tensile carriers;

FIG. 6*a* shows an exemplifying illustration of an exemplifying form of embodiment of a contacting device and tensile carriers;

FIG. 6*b* shows a sectional illustration of the contacting device of FIG. 6*a* along the section A-A;

FIG. 6*c* shows a sectional illustration of the contacting device of FIG. 6*a* along the section B-B; and FIG. 7 shows an exemplifying illustration of a contact element.

DETAILED DESCRIPTION OF THE INVENTION

Figure 1:
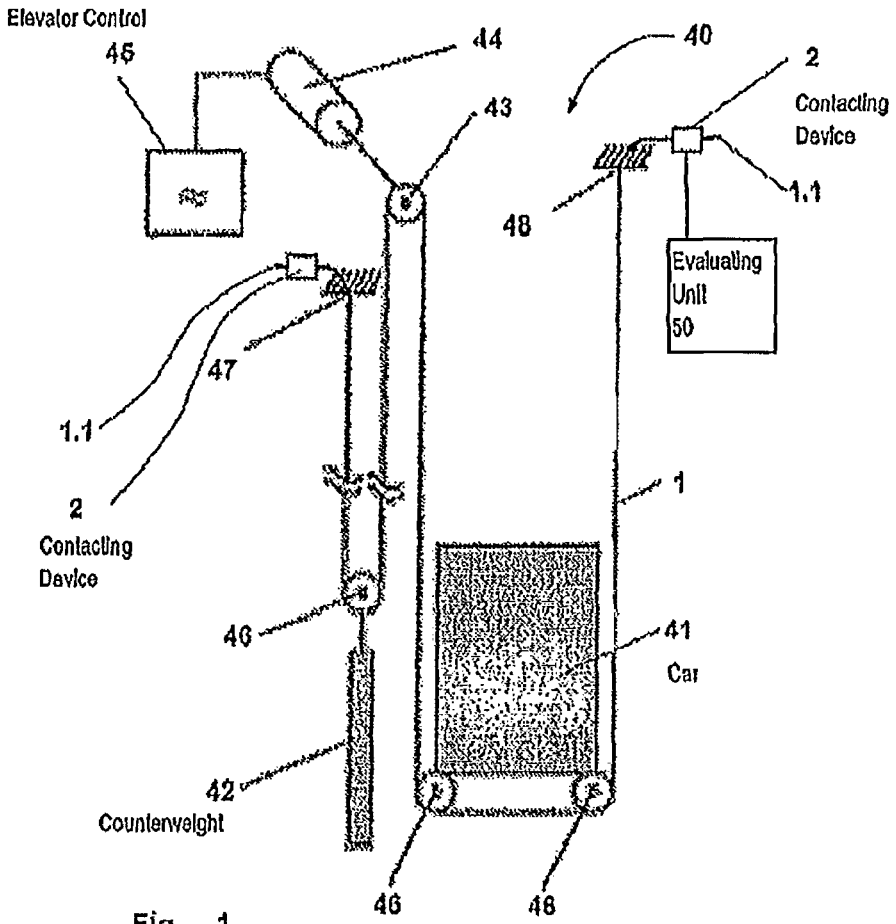
FIG. 1 shows an exemplifying form of embodiment of an elevator installation with a contacting device.

In FIG. 1 two contacting devices 2 for contacting a support means 1 are installed in an elevator installation 40. The schematic and exemplifying elevator installation 40 includes at least one elevator car 41, counterweight 42 and support means 1 as well as drive pulley 43 with associated drive motor 44. The drive pulley 43 drives the support means 1 and thus moves the elevator car 41 and the counterweight 42 in opposite sense. The drive motor 44 is controlled by an elevator control 45. The car 41 is designed to accept persons and/or goods and to transport them between floors of a building. Car 41 and counterweight 42 are guided along guides. In the example, the car 41 and the counterweight 42 are respectively suspended at support rollers 46. The support means 1 is in that case fixed at a support means fastening device 47 and then initially guided around the support roller 46 of the counterweight. The support means 1 is then laid over the drive pulley 43, guided around the support roller 46 of the car 41 and finally connected by a further support means fastening device 48 with a fixing point. This means that the support means 1 runs over the drive 43, 44 at a higher speed in correspondence with a suspension factor. In the example, the suspension factor is 2:1.

The support means 1 is fastened in the building by way of the support means fastenings 47, 48. The support means fastenings 47, 48 introduce tension forces of the support means 1 into the building.

A free end 1.1 of the support means 1 is provided with the contacting device 2 for temporary or permanent contacting of the support means 1. In the illustrated example a contacting device 2 of that kind is arranged at both ends of the support means 1. The support means ends 1.1 are no longer loaded by the tension force in the support means 1, since this tension force has already been conducted beforehand into the building by way of the support means fastenings 47, 48.

The illustrated elevator installation 40 is by way of example. Other suspension factors and arrangements are possible. The contacting device 2 for contacting the support means 1 is then arranged in correspondence with the positioning of the support means fastenings 47, 48.

Figure 2:
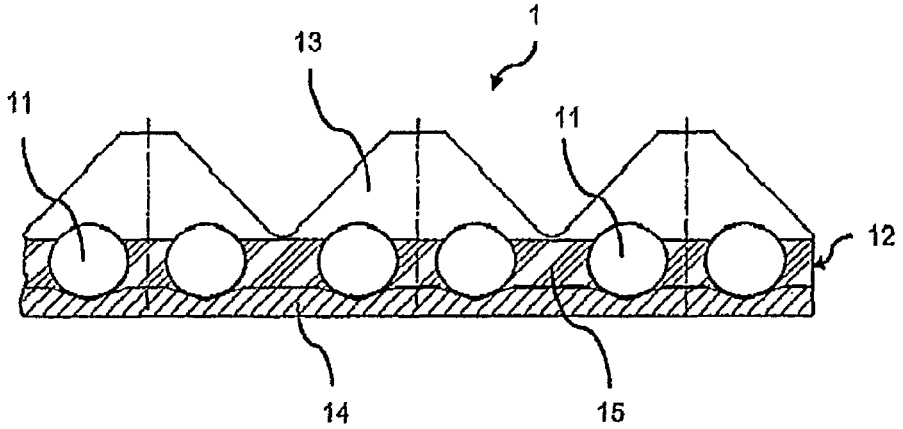
FIG. 2 shows a sectional illustration of an exemplifying form of embodiment of a support means.

FIG. 2 shows a section through an exemplifying form of embodiment of a support means 1. The support means 1 has tensile carriers 11 which are arranged in a casing 12. In that case the tensile carriers 11 are preferably arranged in a plane and parallel to one another. The casing 12 encloses the tensile carriers 11.

The tensile carriers 11 are typically steel strands. However, use can also be made of other electrically conductive materials or also plastics material strands with individual strands of electrically conductive material.

In an advantageous form of embodiment the support means 1 has a rear side and a traction side. A rear layer 14 which has different or the same characteristics as a casing body 15 can be arranged on a rear side of the support means 1. The rear layer 14 preferably consists of a harder and/or more tear-resistant material than the casing body 15, which increases the service life of the support means 1.

Ribs 13 extending in the longitudinal direction of the support means 1 can be arranged on the traction side opposite the rear side. Such ribs 13 improve the traction of the support means 1. In addition, the support means 1 with longitudinal ribs 13 can have better lateral guidance through a structure, which is adapted to the ribs, on the deflecting roller 46 and drive roller 43. The ribs 13 can consist of the same material as or a different material from the casing body 15.

Figure 3:
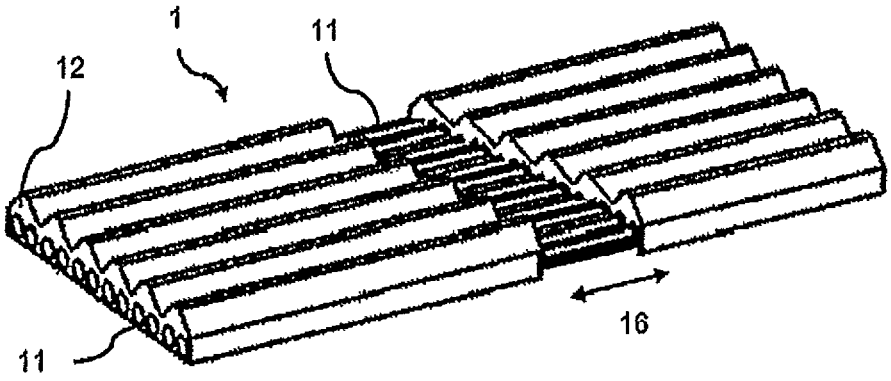
FIG. 3 shows an exemplifying form of embodiment of a support means.

FIG. 3 shows a support means 1 having no casing 12 on a section 16. The tensile carriers 11 are exposed at the section 16 and can therefore be contacted by a contacting device without the casing 12 having to be penetrated. The section 16 can be arranged near an end 1.1 of the support means 1 or at another point of the support means 1. For example, the section 16 can be arranged directly at an end 1.1 of the support means 1 (not illustrated).

A method suitable for the exposing is, for example, the use of steel brushes or other mechanical methods. In that case, the casing 12 can, in an exemplifying form of embodiment, be brushed away by means of a rotating steel brush. In an alternative exemplifying form of embodiment the casing 12 is ground away by rotating grindstones. Alternatively thereto chemical substances or heat can also be used. Different methods for exposing can also be combined together and these methods can preferably be automated.

The support means 1 can, for example, be supplied pretreated to the assembly location of the elevator so that an engineer no longer has to undertake exposure of the tensile carriers 11.

Figure 4:
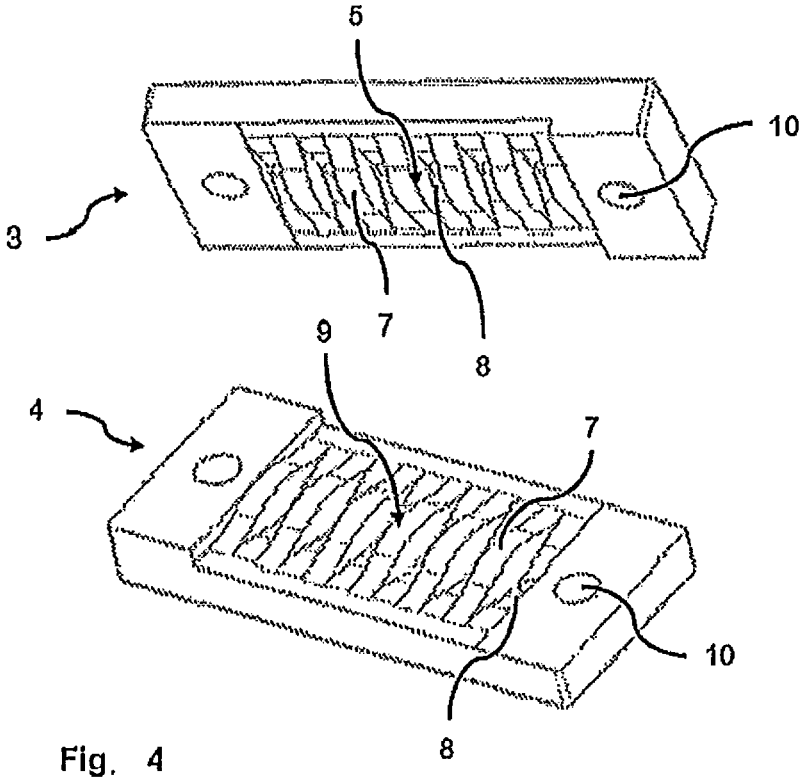
FIG. 4 shows an exemplifying form of embodiment of a housing of a contacting device.

FIG. 4 shows an exemplifying housing 3, 4 of an exemplifying contacting device. In one form of embodiment the illustrated housing 3, 4 consists of a first housing part 3 and a second housing part 4 which can be held together by housing fastening elements 10. By virtue of the two-part arrangement of the housing 3, 4 the mounting of the contacting device 2 is simplified, particularly if the contacting device 2 is mounted more remotely from an end 1.1 of the support means 1 (FIG. 1).

The housing 3, 4 of the contacting device 2 preferably consists of stiff material such as, for example, stiff plastic, plastic reinforced by metal structures, or stiff metal. The housing 3, 4 is preferably constructed to be stiff in bending so that higher levels of force can be exerted by the housing 3, 4 on the tensile carriers 11 without the housing 3, 4 changing its shape.

The housing 3, 4 has two inner sides 5, 9. In the illustrated exemplifying embodiment the first housing part 3 has a first inner side 5 and the second housing part 4 has a second inner side 9. These inner sides 5, 9 are oriented towards one another in a use state.

Elevations 7 and depressions 8 are arranged in alternation adjacent to one another on the inner sides 5, 9 of the housing 3, 4. In that case, the number of elevations 7 on the first inner side 5 corresponds with the number of depressions 8 on the second inner side 9. The number of elevations 7 preferably corresponds with the number of depressions on each inner side 5, 9. In the exemplifying form of embodiment shown in FIG. 4 six elevations 7 and six depressions 8 are respectively arranged on each inner side 5, 9.

The elevations 7 are preferably curved and the depressions 9 are preferably similarly curved, wherein the curved shape of the elevations 7 and of the depressions 8 are matched to one another. In FIG. 4 the elevations 7 and depressions 8 have a continuously curved curve shape in the direction of the tensile carriers 11 to be received. In alternative forms of embodiment, which are not illustrated, the elevations 7 and depressions 8 can also be of different shape, for example step-like or curved with straight sections in-between. The elevations should be suitable for the purpose of separating, in a use state, the tensile carriers 11 at a specific section from one another and pressing them into the respectively opposite depressions 8.

The elevations 7 preferably consist of electrically non-conductive material. The elevations 7 thereby cannot electrically conductively connect together two adjacent tensile carriers 11. An electrical bridging over of two adjacent tensile carriers 11 would in certain circumstances lead to false conclusions in the evaluation of the signal. The elevations 7 can also be made of an electrically conductive material which is at least partly covered by an electrically non-conductive layer.

A further exemplifying form of embodiment of the contacting device 2 is illustrated in FIGS. 5*a* and 5*b* as well as in FIGS. 6*a*, 6*b* and 6*c*. In FIG. 5*a* an exploded illustration of the contacting device 2 and tensile carriers 11 is shown and in FIG. 5*b* the contacting device 2 is illustrated in a use state.

A contacting device 2 with tensile carriers 11 inserted therein of a support means in shown in FIG. 6*a*. In FIG. 6*b* the contacting device 2 of FIG. 6*a* is illustrated along the section line A-A and in FIG. 6*c* the contacting device 2 of FIG. 6*a* is illustrated along the section line B-B. The following descriptions refer to FIGS. 5*a* to 6*c*.

In a use state the exposed tensile carriers 11 of the section 16 of the support means 1 (FIG. 3) are at least partly enclosed by the housing 3, 4. The exposed section 16 can in that case be so dimensioned that the housing 3, 4 in a use state substantially covers the entire section 16.

Each tensile carrier 11 is urged by an elevation 7 into a depression 8 on the respectively oppositely inner side 5, 9. The elevations 7 thereby separate the tensile carriers 11 from one another and guide each of them to a respective contact element 6.

The elevations 7 can have guide grooves so that the tensile carriers 11 do not slip off the elevations 7 when the first housing part 3 and the second housing part 4 are brought together (not shown).

As shown in FIG. 6*b*, the elevations 7 and the depressions 8 of the respectively opposite inner side 5, 9 protrude into one another in a use state. The housing parts 3, 4 then close and a zigzag-shaped cavity between the first housing part 3 and the second housing part 4 in which the tensile carriers 11 are disposed arises. The elevations 7 and the depressions 8 can then be so dimensioned that elevations 7 of different housing parts do not contact. In one form of embodiment (not illustrated) the elevations 7 are formed to be wider and the depressions 8 narrower so that the housing parts 3, 4 flushly interengage without a continuous cavity arising. The height of the elevations 7 and depth of the depressions 8 are matched to one another in such a manner that in a use state a gap between opposite elevations 7 and depressions 8 arises which substantially corresponds with the diameter of the tensile carriers 11 and the height of the contact elements 6 together.

In the exemplifying embodiment shown in FIG. 6*b* the elevations 7 of the two housing parts 3, 4 overlap. However, the elevations 7 can also be constructed with a lower height so that in a use state the elevations 7 of the two housing parts 3, 4 do not overlap. The elevations 7 and depressions 8 then similarly protrude into one another without the elevations 7 of the housing parts 3, 4 overlapping. By protruding into one another it is thus meant that elevations 7 and depressions 8 in a use state are respectively disposed opposite one another so that the elevations 7 guide the tensile carriers 11 to the respectively opposite depressions 8. In that case, elevations of different housing parts 3, 4 can either overlap or not overlap.

The fastening element 10 holds together the first housing part 3 and the second housing part 4. The first housing part 3 and the second housing part 4 are detachably connected together. Provided as fastening elements 10 can be, for example, screws and corresponding threads or other fastening mechanisms such as, for example, a clip system with a male part and a female part.

The housing 3, 4 of the contacting device 2 can, however, also be of integral construction. In this case the second housing part 4 and the first housing part 3 can be connected together at one side by way of hinge (not shown). In this form of embodiment only one fastening element 10 is needed, which is arranged on the side opposite the hinge.

A respective contact element 6 is arranged in each of the depressions 8. In that case, the contact elements 6 and the depressions 8 are preferably dimensioned in such a manner that a tensile carrier 11 is pressed flushly against a contact element 6 when the housing 3, 4 is completely closed. In order to ensure a constant electrical contact between the tensile carrier 11 and the contact element 6 the contact elements 6 can be of resilient design. For that purpose, for example, a spring can be arranged between the contact element 6 and the housing 4, 3 or the contact element 6 itself can be constructed as a resilient element.

In a use state the tensile carriers 11 are pressed by the elevations 7 alternately onto a first and second plane (FIG. 6*b*). In that case, the number of tensile carriers 11 on the first plane corresponds with the number of tensile carriers 11 on the second plane, wherein two adjacent tensile carriers 11 lie on different planes.

In an exemplifying embodiment the contact elements 6 are arranged in push-in slots 21 of the housing 3, 4. The contact elements 6 preferably reach from the contact point with the tensile carrier 11 into the interior of the housing 3, 4 as far as outside the housing 3, 4 (FIG. 6*a*). The contact elements 6 can thereby be contacted in simple mode and manner in order, for example, to be connected to an evaluating unit.

Since the tensile carriers 11 are at least in part exposed, the exposed sections of the tensile carriers 11 and/or the contact elements of the contacting device 2 can corrode at the moist ambient air. For protection against such corrosion the exposed tensile carrier sections and/or the contact elements and/or parts of the housing 3, 4 or the entire housing 3, 4 can be sealed by a material so that the ambient air can no longer reach the elements susceptible to corrosion. For that purpose, for example, adhesive materials, casting materials or sealing materials can be arranged around the elements susceptible to corrosion so that these are gas-tightly closed off relative to the ambient air.

FIG. 7 shows an individual exemplifying contact element 6. A terminal point 19 is located at one end of the contact element 6. In a use state this terminal point 19 is connected with further electrical and electronic units for signal transmission and signal processing.

A projection 18 is arranged at the end opposite the terminal point 19. In a use state this projection 18 is disposed between a tensile carrier 11 and an opening 22 of the housing 3, 4 (FIGS. 5*a* to 6*c*). The projection 18 is preferably flexible so that it is urged by the tensile carrier 11 somewhat into the opening 22. The projection 18 thereby lies under stress against the tensile carrier 11 which has the consequence of a more secure contact. In the case of vibrations the projection 18 follows the tensile carrier 11 so that the electrical contact between the contact element 6 and the tensile carrier 11 is maintained.

The contact elements 6 are preferably electrically connected with an evaluating unit (not shown). In that case each contact element 6 can be contacted or only individual contact elements 6, for example only those contact elements 6 which are in electrical contact with the outermost tensile carriers 11 of the support means 1. If not all contact elements 6 are contacted, they can be electrically interconnected. Through such bridge connections between the tensile carriers 11 of the support means 1 several tensile carriers 11 can be combined into an electrical circuit which reduces the number of necessary measuring processes.

In the elevator installation 40 schematically illustrated in FIG. 1 preferably only a first contacting device 2 is connected with an evaluating unit 50. A second contacting device 2 is preferably used as a bridging device. For that purpose the contact elements of the second contacting device 2 are electrically interconnected so that two or more tensile carriers 11 together form an electrical circuit. At the first contacting device 2, each contact element can be connected with the evaluating unit or two or more tensile carriers can be electrically interconnected.

In this mode and manner electrical circuits with two or more tensile carriers 11 can be formed. For example, all tensile carriers 11 of a support means 1 can be connected with a single electrical circuit or in each instance two adjacent tensile carriers 11 can be connected with an electrical circuit. The fewer electrical circuits are formed, the fewer measuring processes are needed. However, in the case of electrical circuits with several tensile carriers 11 it is not possible to immediately establish in which tensile carrier 11 a defect has arisen.

Before arranging the contacting device 2 at the support means 1 the casing 12 is removed on a section 16 of the support means 1 (FIG. 3). This can be carried out, for example, by mechanical methods such as the use of a steel brush and/or chemical methods and/or the use of heat. The length of the exposed section 16 is preferably somewhat greater than the width of the housing 3, 4 so that through bending of the tensile carriers 11 in the contacting device 2 the section 16 is substantially covered by the contacting device 2.

In an exemplifying form of embodiment, for arrangement of the contacting device 2 at the support means 1 a first housing part 3 and a second housing part 4 are each arranged on a respective side of the support means 1. The first housing part 3 and the second housing part 4 are detachably connected together by way of fastening elements 10. For example, screws and corresponding threads can be used for that purpose.

When the first housing part 3 and the second housing part 4 are brought together the tensile carriers 11 are received by the elevations 7. The tensile carriers 11 are thereby bent over the curved elevations 7. Adjacent tensile carriers 11 are separated from one another, because the tensile carriers 11 are received in alternation by an elevation 7 of the first housing part 3 and by an elevation 7 of the second housing part 4. The tensile carriers 11 are thus urged out of their original plane onto two new and different planes. A first half of the tensile carriers 11 is pressed onto a first plane and a second half of the tensile carriers 11 is pressed onto a second plane, so that in a use state adjacent tensile carriers 11 are disposed on different planes (FIG. 6*b*).

The urging of the tensile carriers 11 out of the original position thereof preferably takes place during bringing together of the first housing part 3 and the second housing part 4. If screws are used as fastening elements 10 the tensile carriers 11 are, by tightening these screws, pressed by the elevations 7 into the respectively opposite depressions 8 and fed to the contact elements 6 arranged in these depressions 8. However, this process can also be formed with different kinds of fastening elements. However, it is necessary to ensure that when the first housing part 3 and the second housing part 4 are brought together sufficient force is applied in order to bend the tensile carriers 11 over the elevations 7.

After contacting of the tensile carriers 11 by the contact element 6 has been carried out a voltage is applied so that a test current flows through the tensile carriers 11 or through the tensile carriers 11 connected into a circuit so as to ascertain the state of the tensile carriers 11. In the case of damaged tensile carriers 11 the electrical resistance in the tensile carriers 11 is greater, which can be established evaluation of the test current.

In an exemplifying embodiment an electrical resistance for an electrical circuit consisting of one or more tensile carriers 11 is determined by means of a test current. This measured electrical resistance is then compared with a threshold value and it is ascertained whether the measured electrical resistance is greater or smaller than the threshold value. The threshold value is preferably selected so that a measured electrical resistance which is greater than the threshold value allows a conclusion about an interrupted, torn or incipiently torn tensile carrier 11.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A contacting device for electrical contacting of tensile carriers of a support means in an elevator installation, the contacting device comprising:

a housing in which an exposed section of the support means is received so that the housing at least partly encloses the exposed section of the support means in a use state;

a plurality of contact elements arranged in the housing; and a plurality of elevations and depressions arranged on inner sides of the housing and which in a use state project into one another in order to hold tensile carriers of the support means in the housing and to bring the tensile carriers into electrical contact with the contact elements.

2. The contacting device according to claim 1 wherein the elevations are curved and wherein the depressions are similarly curved, wherein curve shapes of the elevations and the depressions are cooperatively matched to one another.

3. The contacting device according to claim 1 wherein the elevations are constructed from electrically non-conductive material or are at least partly coated with electrically non-conductive material.

4. The contacting device according to claim 1 wherein the housing includes of a first housing part and a second housing part, wherein the first housing part and the second housing part are detachably connectible with one another.

5. The contacting device according to claim 4 wherein a number of the elevations arranged at the first housing part is equal to a number of the elevations arranged at the second housing part.

6. The contacting device according to claim 1 wherein a number of the elevations corresponds to a number of the tensile carriers.

7. An elevator installation having a car and a counterweight, wherein the car and the counterweight are movable by the support means driven by a drive and wherein a contacting device according to claim 1 is arranged at the support means.

8. The elevator installation according to claim 7 wherein a respective contacting device is arranged between a support means fastening device and each end of the support means, and wherein one of the contacting devices electrically connects together at least two tensile carriers of the support means and another of the contacting devices is connected with an evaluating unit.

9. A method of electrical contacting of tensile carriers in a support means of an elevator installation, the method comprising the steps of:

arranging a housing at an exposed section of the support means so that the section is at least partly enclosed by the housing; and urging at least one of the tensile carriers out of an original position thereof by at least one elevation arranged on an inner side of the housing so that an electrical contact is produced between the at least one tensile carrier and a contact element arranged in the housing.

10. The method according to claim 9 wherein a casing is removed on the section of the support means by at least one of applying heat, mechanical processing and applying a chemical substance.

11. The method according to claim 9 including urging each of a plurality of tensile carriers of the support means by a respective elevation into a respective depression arranged in the housing.

12. The method according to claim 9 wherein after production of an electrical contact between the at least one tensile carrier and the contact element a voltage is applied so that a test current flows through the at least one tensile carrier.

13. The method according to claim 9 wherein the at least one tensile carrier is urged out of the original position by bringing together a first housing part and a second housing part of the housing.

14. The method according to claim 13 wherein a plurality of tensile carriers of the support means are guided by guide grooves arranged on a plurality of elevations arranged in the housing when the first housing part and the second housing part are brought together.

15. The method according to claim 13 wherein the first housing part and the second housing part are detachably connected together by fastening elements.

* * * * *